US010739018B2

(12) United States Patent
Baumann et al.

(10) Patent No.: US 10,739,018 B2
(45) Date of Patent: Aug. 11, 2020

(54) SADDLE WINDOW AIR CONDITIONER WITH AN ADJUSTABLE CHASEWAY

(71) Applicant: Haier US Appliance Solutions, Inc., Wilmington, DE (US)

(72) Inventors: Robert Edward Baumann, Shumway, IL (US); Brice Alan Bowley, Goshen, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 64 days.

(21) Appl. No.: 16/166,210

(22) Filed: Oct. 22, 2018

(65) Prior Publication Data

US 2020/0124296 A1 Apr. 23, 2020

(51) Int. Cl.

| | |
|---|---|
| ***F24F 13/32*** | (2006.01) |
| ***F24F 1/027*** | (2019.01) |
| *F24F 1/02* | (2019.01) |
| *F24F 13/22* | (2006.01) |
| *F24F 5/00* | (2006.01) |
| *F24F 7/02* | (2006.01) |
| *F24F 13/18* | (2006.01) |
| *F24F 1/031* | (2019.01) |
| *F24F 7/013* | (2006.01) |

(52) U.S. Cl.

CPC ..... *F24F 1/027* (2013.01); *F24F 13/32* (2013.01); *F24F 1/02* (2013.01); *F24F 1/031* (2019.02); *F24F 5/0075* (2013.01); *F24F 7/013* (2013.01); *F24F 7/02* (2013.01); *F24F 7/025* (2013.01); *F24F 13/18* (2013.01); *F24F 13/224* (2013.01); *F24F 2221/20* (2013.01)

(58) Field of Classification Search

CPC ..... F24F 1/027; F24F 1/031; F24F 5/0075; F24F 7/013; F24F 13/18; F24F 13/224; F24F 2221/20; F24F 1/02; F24F 7/02; F24F 7/025; F24F 13/32

See application file for complete search history.

(56) References Cited

U.S. PATENT DOCUMENTS

| | | | | |
|---|---|---|---|---|
| 3,176,474 A | | 4/1965 | Abbott | |
| 5,191,770 A | * | 3/1993 | Kim | F24F 1/0003 285/273 |
| 6,568,201 B1 | | 5/2003 | Cur et al. | |
| 10,156,369 B2 | * | 12/2018 | Booten | F16L 5/10 |
| 2009/0107162 A1 | * | 4/2009 | Su | F24F 1/027 62/263 |

FOREIGN PATENT DOCUMENTS

CN 101876466 A 11/2010

* cited by examiner

*Primary Examiner* — David J Teitelbaum
(74) *Attorney, Agent, or Firm* — Dority & Manning, P.A.

(57) ABSTRACT

A saddle window air conditioner includes an interior casing and an exterior casing. A chaseway extends between the interior casing and the exterior casing. A first sleeve of the chaseway is slidably received within a second sleeve of the chaseway such that a length of the chaseway between the interior casing and the exterior casing is adjustable by sliding the first sleeve within the second sleeve. A mounting bracket is mountable at a window. The mounting bracket includes a support leg, a lift foot slidably mounted to the support leg, and a spring coupled to the lift foot. The lift foot is connectable to the exterior casing. The spring urges the lift foot and the exterior casing upwardly on the support leg when the mounting bracket is positioned in the window and the lift foot is connected to the exterior casing.

17 Claims, 8 Drawing Sheets

SADDLE WINDOW AIR CONDITIONER WITH AN ADJUSTABLE CHASEWAY

FIELD OF THE INVENTION

The present subject matter relates generally to saddle window air conditioners.

BACKGROUND OF THE INVENTION

Saddle window air conditioners allow a window to be freely opened and closed when the saddle window air conditioner is installed in the window. Thus, such air conditioners may be used to cool air within a home while also allowing the window to be opened to allow in fresh air. Saddle window air conditioners may also be quieter than other window air conditioners due to the placement of a fan and compressor outside of the cooled room. However, variations in a wall or window thickness that must be spanned by the saddle can make installation of saddle window air conditioners difficult. In addition, the weight of such air conditioners can also make installation difficult.

BRIEF DESCRIPTION OF THE INVENTION

Aspects and advantages of the invention will be set forth in part in the following description, or may be apparent from the description, or may be learned through practice of the invention.

In a first example embodiment, a saddle window air conditioner includes an interior casing. An exterior casing is spaced from the interior casing. A chaseway extends between the interior casing and the exterior casing. The chaseway includes a first sleeve mounted to one of the interior casing and the exterior casing and a second sleeve mounted to the other of the interior casing and the exterior casing. The first sleeve is slidably received within the second sleeve such that a length of the chaseway between the interior casing and the exterior casing is adjustable by sliding the first sleeve within the second sleeve. A mounting bracket is mountable at a window. The mounting bracket includes a support leg, a lift foot slidably mounted to the support leg, and a spring coupled to the lift foot. The lift foot is connectable to the exterior casing. The spring urges the lift foot and the exterior casing upwardly on the support leg when the mounting bracket is positioned in the window and the lift foot is connected to the exterior casing.

In a second example embodiment, a saddle window air conditioner includes an interior casing. An exterior casing is spaced from the interior casing. A chaseway extends between the interior casing and the exterior casing. The chaseway includes a first sleeve mounted to one of the interior casing and the exterior casing and a second sleeve mounted to the other of the interior casing and the exterior casing. The first sleeve is slidably received within the second sleeve such that a length of the chaseway between the interior casing and the exterior casing is adjustable by sliding the first sleeve within the second sleeve. A mounting bracket is mountable at a window. The mounting bracket includes a pair of support legs, a pair of lift feet and a pair of springs. Each of the pair of lift feet is slidably mounted to a respective one of the pair of the support legs. Each of the pair of springs is coupled to a respective one of the pair of lift feet. The pair of lift feet is connectable to the exterior casing. The pair of springs urges the pair of lift feet and the exterior casing upwardly on the pair of support legs when the mounting bracket is positioned in the window and the pair of lift feet is connected to the exterior casing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
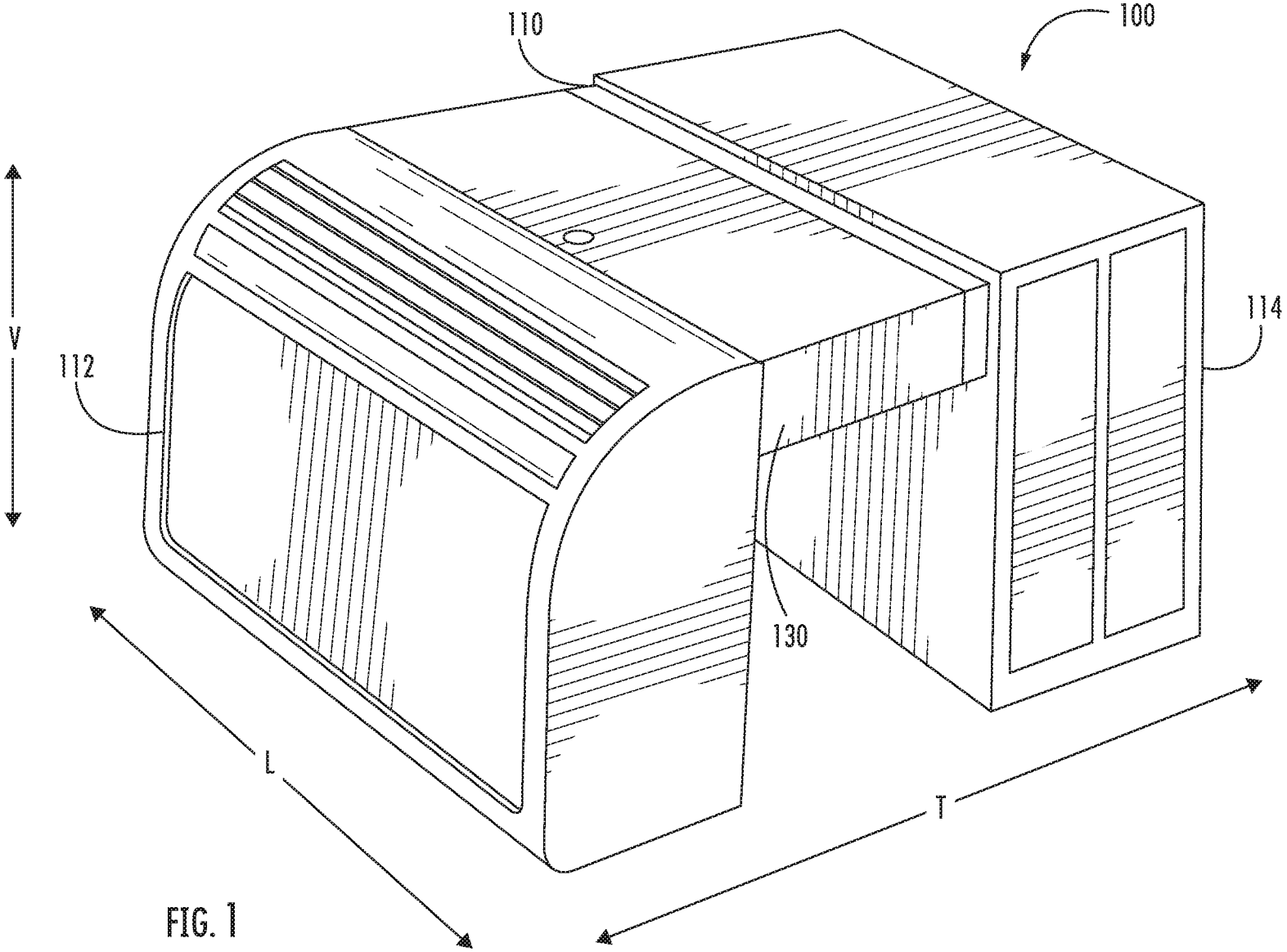
FIG. 1 is a perspective view of a saddle window air conditioner according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
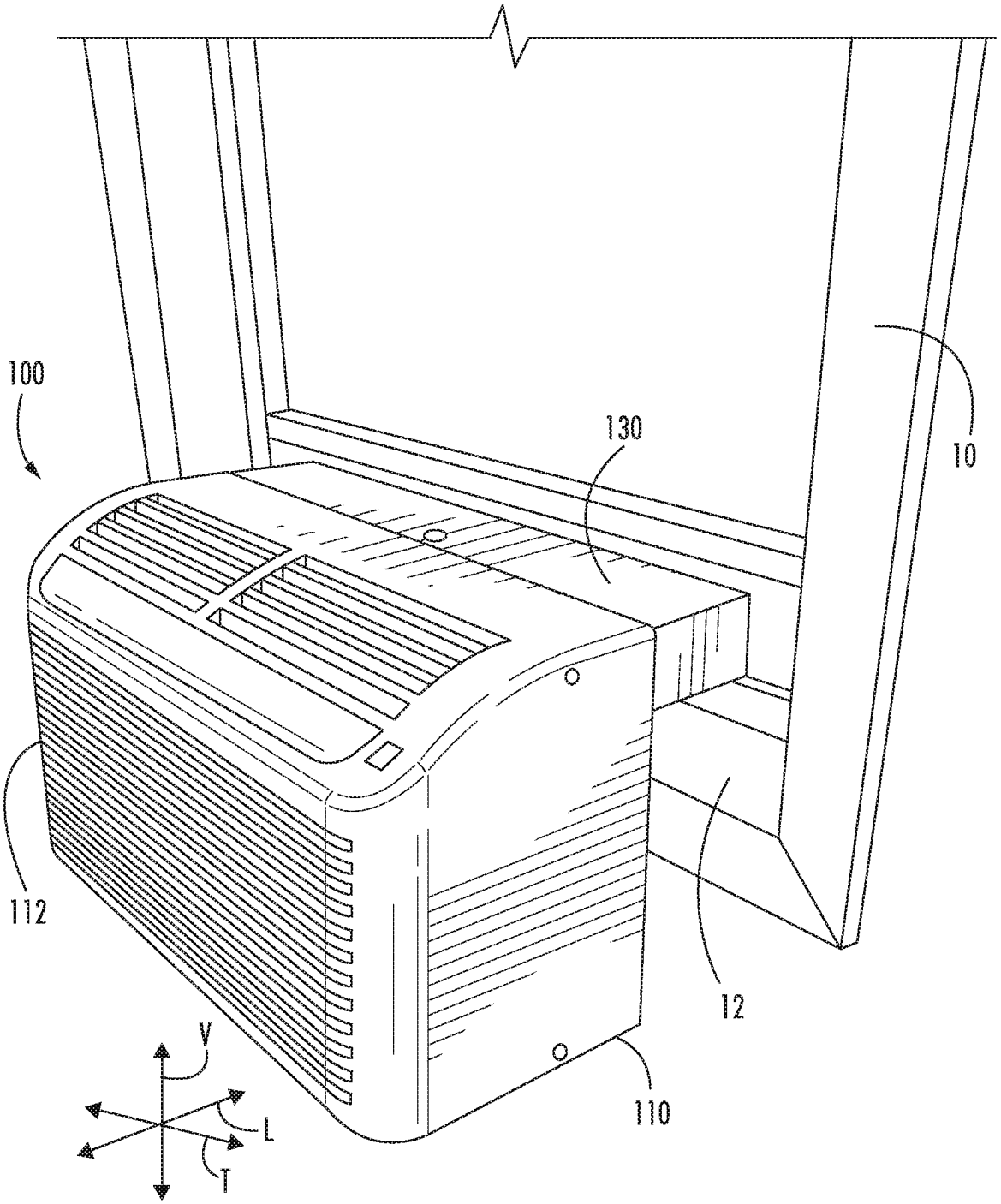
FIG. 2 is an interior perspective of the example saddle window air conditioner of FIG. 1 installed in a window.

FIG. 1 is a perspective view of a saddle window air conditioner 100 according to an example embodiment of the present subject matter. FIG. 2 is an interior perspective of saddle window air conditioner 100 installed in a window 10. Saddle window air conditioner 100 is operable to generate chilled and/or heated air in order to regulate the temperature of an associated room or building. As will be understood by those skilled in the art, saddle window air conditioner 100 may be installed within window 10 to cool and/or heat air on an interior side of window 10 to a selected temperature. As discussed in greater detail below, a sealed system 120 (FIG. 3) of saddle window air conditioner 100 is disposed within a casing assembly 110. Thus, saddle window air conditioner 100 may be a self-contained or autonomous system for heating and/or cooling air. Saddle window air conditioner 100 defines a vertical direction V, a lateral direction L and a transverse direction T that are mutually perpendicular and form an orthogonal direction system.

As used herein, the term "saddle window air conditioner" is used broadly. For example, saddle window air conditioner 100 may include a supplementary electric heater (not shown) for assisting with heating air within the associated room or building without operating the sealed system 120. However, as discussed in greater detail below, saddle window air conditioner 100 may also include a heat pump heating mode that utilizes sealed system 120, e.g., in combination with an electric resistance heater, to heat air within the associated room or building. Thus, it should be understood that "saddle window air conditioner" as used herein is intended to cover both units with and without heat pump heating modes.

With reference to FIGS. 1 and 2, casing assembly 110 includes an interior casing 112, an exterior casing 114 and a chaseway 130. Interior casing 112 and exterior casing 114 are spaced apart from each other, e.g., along the transverse direction T. Thus, interior casing 112 may be positioned at or contiguous with an interior atmosphere on one side of window 10, and exterior casing 114 may be positioned at or contiguous with an exterior atmosphere on the other side of window 10. Chaseway 130 extends between interior casing 112 and exterior casing 114, e.g., through window 10.

Figure 3:
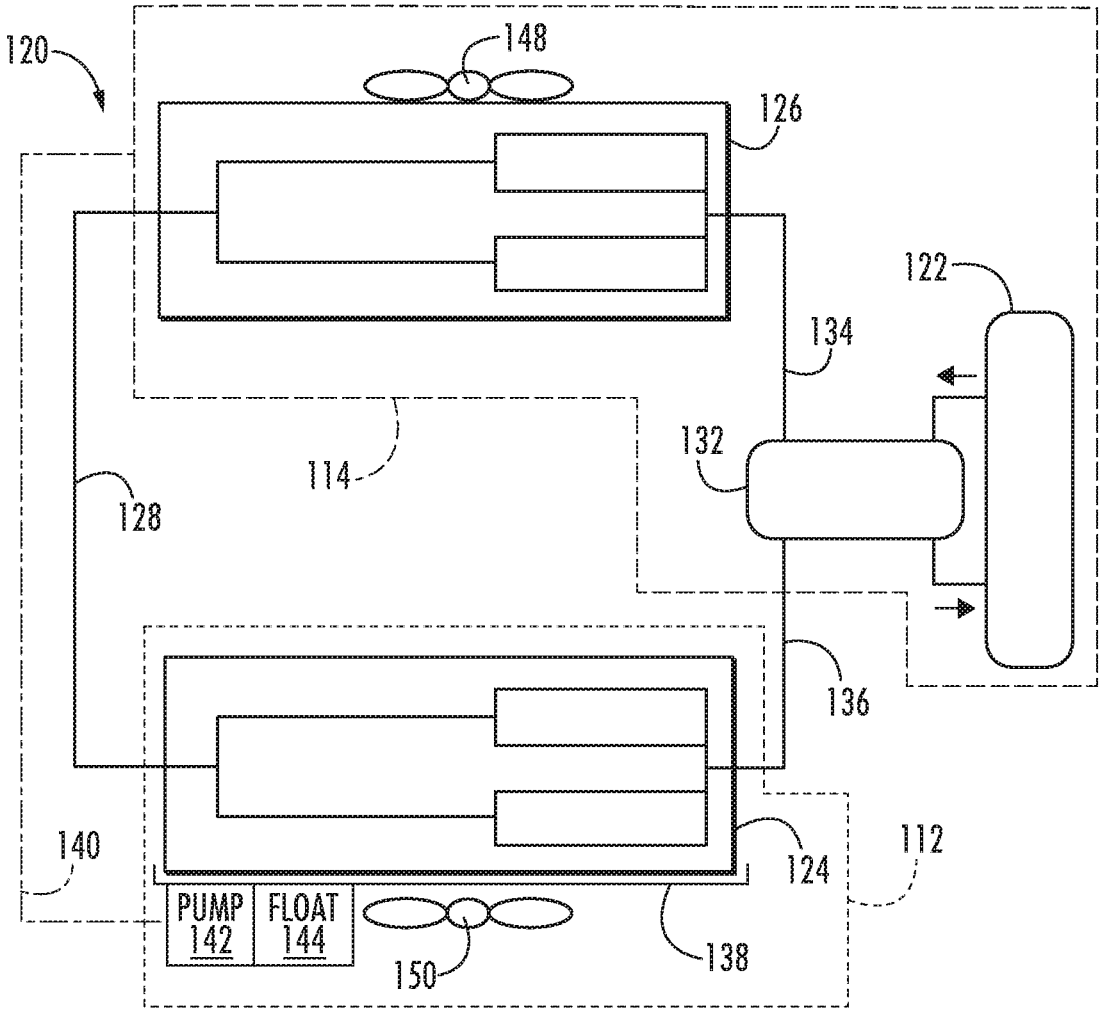
FIG. 3 is a schematic view of a sealed system of the example saddle window air conditioner of FIG. 1.

Turning to FIG. 3, sealed system 120 is disposed or positioned within casing assembly 110, and sealed system 120 includes components for transferring heat between the exterior atmosphere and the interior atmosphere. In particular, various components of sealed system 120 are positioned within interior casing 112 while other components of sealed system 120 are positioned within exterior casing 114.

Saddle window air conditioner 100 further includes a controller (not shown) with user inputs, such as buttons, switches and/or dials. The controller regulates operation of saddle window air conditioner 100. Thus, the controller is in operative communication with various components of saddle window air conditioner 100, such as components of sealed system 120 and/or a temperature sensor, such as a thermistor or thermocouple, for measuring the temperature of the interior atmosphere. In particular, the controller may selectively activate sealed system 120 in order to chill or heat air within sealed system 120, e.g., in response to temperature measurements from the temperature sensor.

The controller includes memory and one or more processing devices such as microprocessors, CPUs or the like, such as general or special purpose microprocessors operable to execute programming instructions or micro-control code associated with operation of saddle window air conditioner 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 3, sealed system 120 may also include a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 136 that extends between and fluidly connects interior coil 124 and reversing valve 132. Within interior coil 124, the refrigerant from capillary tube 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

Interior coil 124 and interior fan 150 may be positioned within interior casing 112. Conversely, compressor 122, exterior coil 126, reversing valve 132 and exterior fan 148 may be positioned within exterior casing 114. In such a manner, certain noisy components of sealed system 120 may be spaced from the interior atmosphere, and saddle window air conditioner 100 may operate quietly. Various fluid passages, such as refrigerant conduits, liquid runoff conduits, etc., may extend through chaseway 130 to fluidly connect components within interior and exterior casings 112, 114.

It should be understood that sealed system 120 described above is provided by way of example only. In alternative example embodiments, sealed system 120 may include any suitable components for heating and/or cooling air with a refrigerant. Sealed system 120 may also have any suitable arrangement or configuration of components for heating and/or cooling air with a refrigerant in alternative example embodiments.

As shown in FIG. 3, saddle window air conditioner 100 also includes a drain pan or bottom tray 138. Components of sealed system 120 within interior casing 112 are positioned on bottom tray 138. Thus, liquid runoff from components of sealed system 120 within interior casing 112 may flow into and collect within bottom tray 138. In particular, interior coil 124 may be positioned over bottom tray 138 along the vertical direction, and liquid runoff from interior coil 124, e.g., generated during a defrost of interior coil 124, may flow downwardly from interior coil 124 into bottom tray 138. Thus, bottom tray 138 may collect defrost melt water from interior coil 124 within interior casing 112. As discussed in greater detail below, saddle window air conditioner 100 also includes features for flowing the liquid runoff in bottom tray 138 out of interior casing 112, e.g., and to exterior casing 114.

Figure 4:
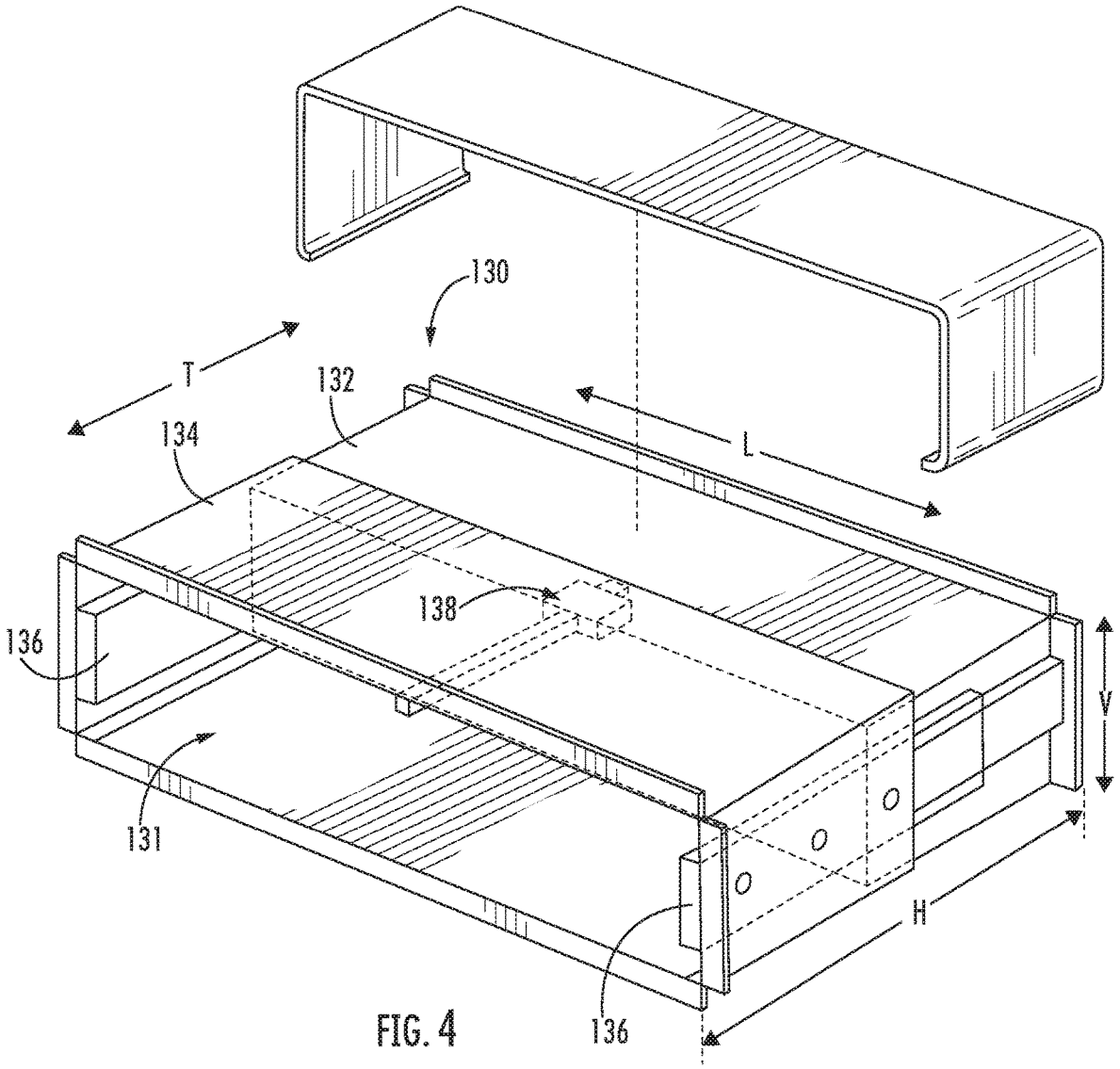
FIG. 4 is a perspective view of a chaseway of the example saddle window air conditioner of FIG. 1.
Figure 5:
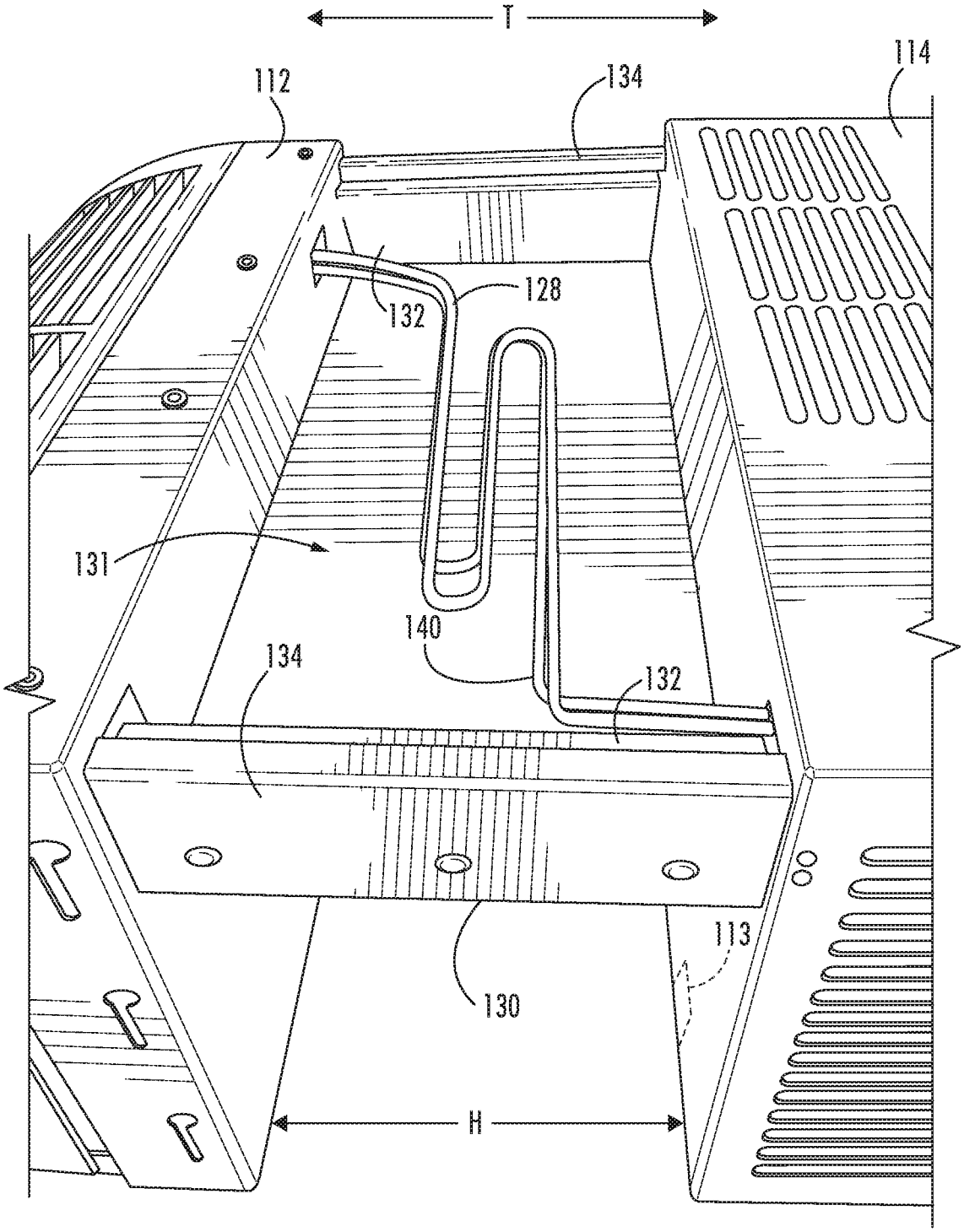
FIG. 5 is a partial, perspective view of the example saddle window air conditioner of FIG. 1 with the chaseway shown in a retracted configuration.
Figure 6:
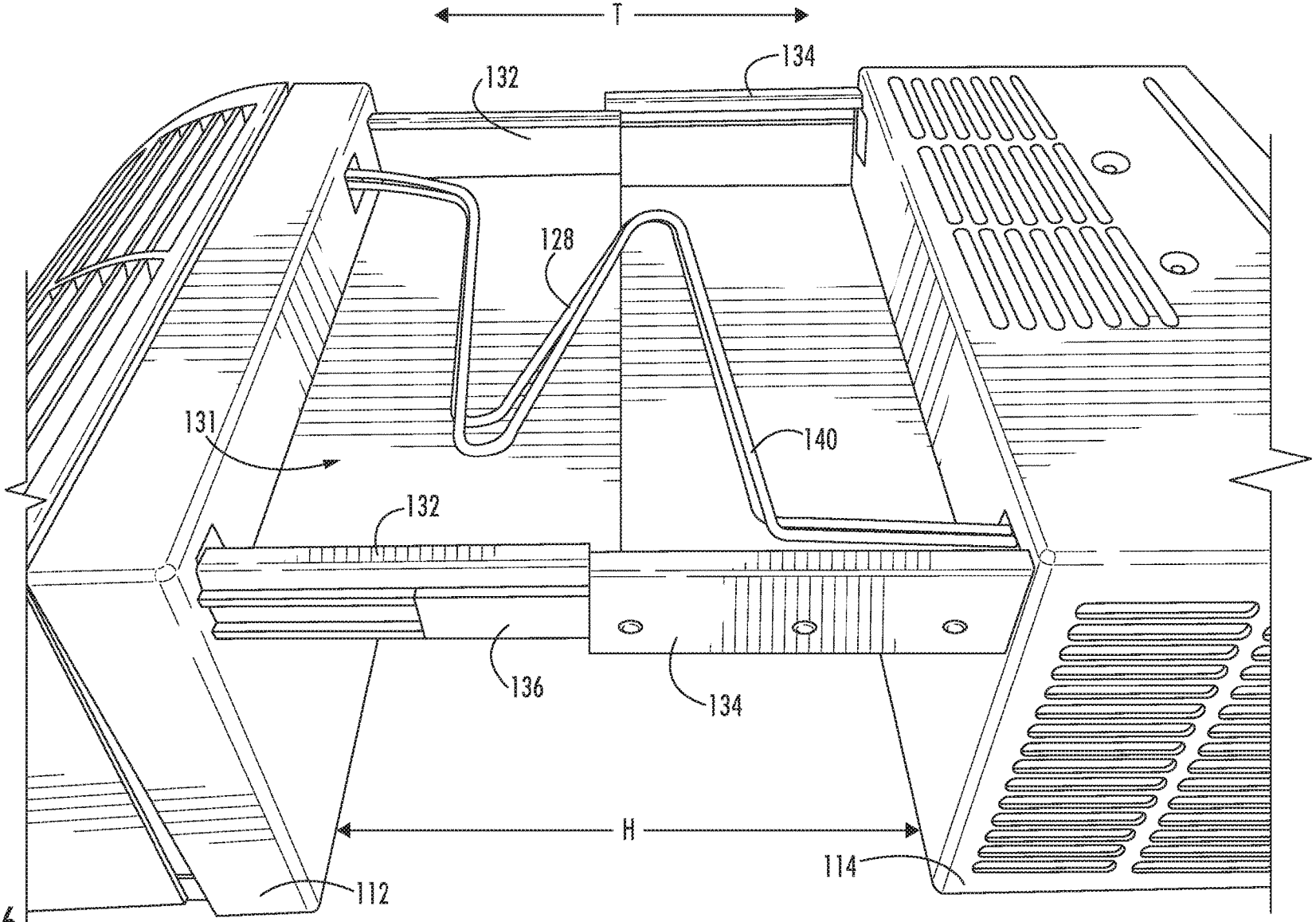
FIG. 6 is a partial, perspective view of the example saddle window air conditioner of FIG. 1 with the chaseway shown in an extended configuration.

FIG. 4 is a perspective view of chaseway 130. FIG. 5 is a partial, perspective view of saddle window air conditioner 100 with chaseway 130 shown in a retracted configuration, and FIG. 6 is a partial, perspective view of saddle window air conditioner 100 with chaseway 130 shown in an extended configuration. As discussed in greater detail below, chaseway 130 may be adjusted to any suitable configuration between the retracted configuration (FIG. 5) and the extended configuration (FIG. 6) in order to fit saddle window air conditioner 100 onto windows with varying widths.

As may be seen in FIG. 4, chaseway 130 includes a first sleeve 132 and a second sleeve 134. First sleeve 132 is mountable to one of interior casing 112 and exterior casing 114, and second sleeve 134 is mountable to the other of interior casing 112 and exterior casing 114. For example, as shown in FIG. 1, first sleeve 132 may be mounted to interior casing 112 such that first sleeve 132 is fixed relative to interior casing 112 and first sleeve 132 projects from interior casing 112 along the transverse direction T, and second sleeve 134 may be mounted to exterior casing 114 such that second sleeve 134 is fixed relative to exterior casing 114 and second sleeve 134 projects from exterior casing 114 along the transverse direction T.

First sleeve 132 is slidably received within second sleeve 134. For example, first sleeve 132 may be slidable within second sleeve 134 along the transverse direction T. In such a manner, a length H of chaseway 130 (e.g., along the transverse direction T) between interior and exterior casings 112, 114 is adjustable by sliding first sleeve 132 within second sleeve 134. As an example, all or most of first sleeve 132 may be positioned within second sleeve 134 when chaseway 130 is in the retracted configuration (FIG. 5). Thus, the length H of chaseway 130 is relatively short in the retracted configuration of chaseway 130 such that interior casing 112 is positioned relatively close to exterior casing 114. As an example, the length H of chaseway 130 may be about eight inches (8") in the retracted configuration of chaseway 130. Conversely, all or most of first sleeve 132 may be positioned outside of second sleeve 134 when chaseway 130 is in the extended configuration (FIG. 6). Thus, the length H of chaseway 130 is relatively long in the extended configuration of chaseway 130 such that interior casing 112 is positioned relatively far from exterior casing 114. As an example, the length H of chaseway 130 may be about fifteen inches (15") in the extended configuration of chaseway 130. By adjusting the spacing between interior and exterior casings 112, 114 via chaseway 130, saddle window air conditioner 100 may be securely installed in windows and walls with varying thicknesses. As used herein the term "about" means within two inches (2") of the stated length when used in the context of lengths.

Chaseway 130 may also include one or more slide rails 136 for slidably mounting first sleeve 132 to second sleeve 134. In certain example embodiments, slide rails 136 include two slide rails 136 positioned within chaseway 130, and each of the two slide rails 136 is positioned at a respective side of chaseway 130 along the lateral direction L. Slide rails 136 may include ball bearings for facilitating sliding of first and second sleeves 132, 134 on slide rails 136. Slide rails 136 may advantageously constrain relative motion between first and second sleeves 132, 134 to along the transverse direction T and may thus block or limit relative motion between first and second sleeves 132, 134 to along the lateral and vertical directions L, T. A cover 135 may snap onto first and second sleeves 132, 134 to cover slide rails 136.

Chaseway 130 may also include a lock 138 for fixing the length H of chaseway 130. In particular, lock 138 may couple first and second sleeves 132, 134 together such that lock 138 prevents sliding of first sleeve 132 within second sleeve 134 and adjustment of chaseway 130 between the retracted and extended configurations. Lock 138 may secure chaseway 130 at any suitable configuration between the retracted and extended configurations. Thus, lock 138 may fix the length H of chaseway 130 at any suitable point between the retracted and extended configurations.

As shown in FIGS. 5 and 6, a condensate tube 140 extends within an interior 131 of chaseway 130. Condensate tube 140 is configured to flow liquid runoff from bottom tray 138 below interior coil 124 within interior casing 112 to exterior casing 114, e.g., and out of saddle window air conditioner 100. Capillary tube 128 may also extend within an interior 131 of chaseway 130. Capillary tube 128 and/or condensate tube 140 may be pleated within chaseway 130 to accommodate the change in the length H of chaseway 130 between the retracted and extended configurations.

As shown in FIG. 3, saddle window air conditioner 100 may also include a pump 142 and a float switch 144. Pump 142 is coupled to condensate tube 140 and is operable to flow the liquid runoff from interior coil 124 within bottom tray 138 to exterior casing 114 through condensate tube 140.

Float switch 144 is coupled to pump 142 and is operable to activate/deactivate pump 142 in response to a fill level of liquid runoff from interior coil 124. For example, float switch 144 may be positioned within bottom tray 138, and liquid runoff from interior coil 124 may flow into bottom tray 138 with float switch 144. As bottom tray 138 fills with liquid runoff from interior coil 124, float switch 144 trips and activates pump 142 when bottom tray 138 is filled with a predetermined fill level of liquid runoff. In such a manner, liquid runoff from interior coil 124 may be evacuated from bottom tray 138 by pump 142 when triggered by float switch 144.

Figure 7:
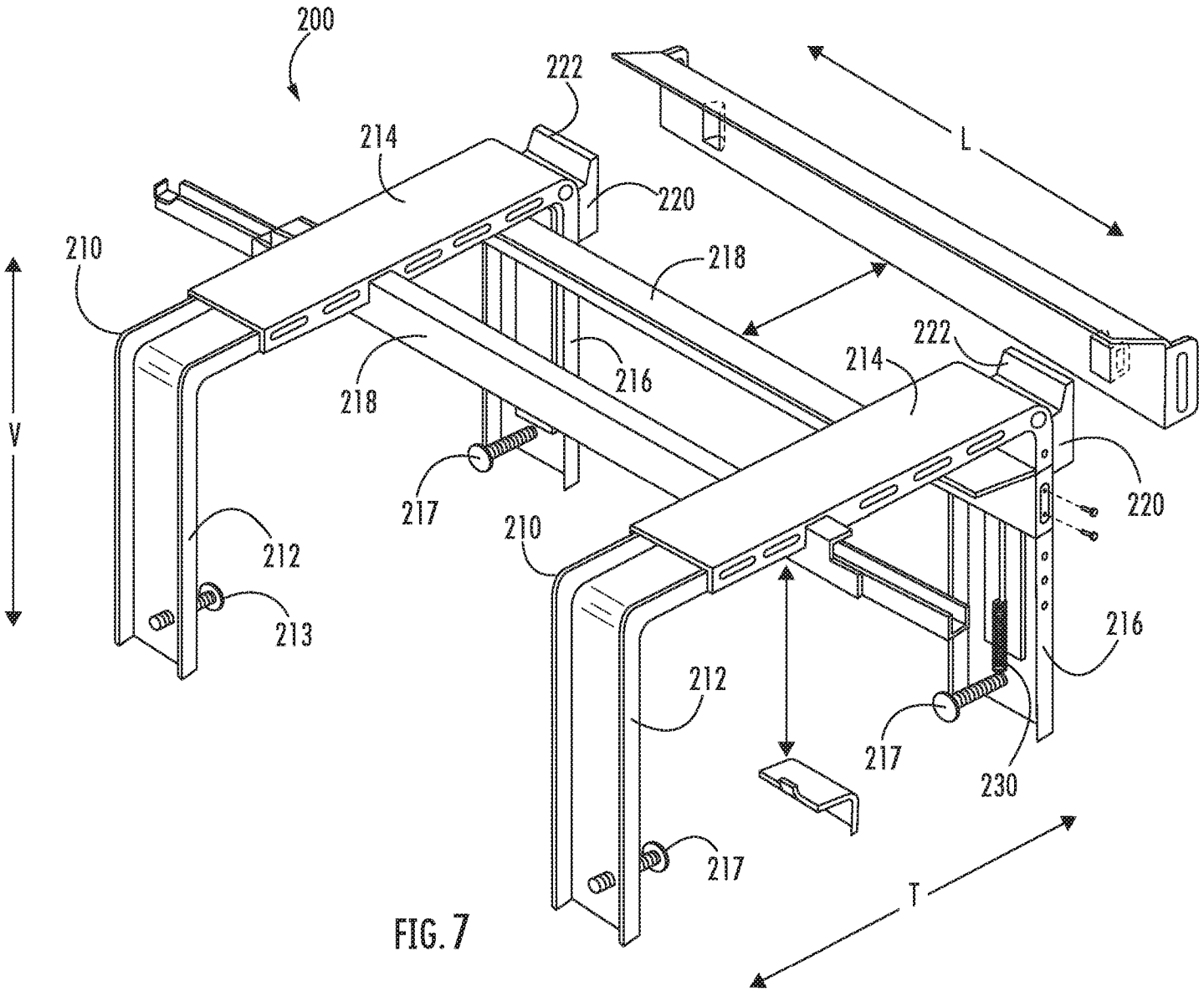
FIG. 7 is a partially, exploded view of a mounting bracket of the example saddle window air conditioner of FIG. 1.

FIG. 7 is a partially, exploded view of a mounting bracket 200 of saddle window air conditioner 100. Mounting bracket 200 includes a pair of support legs 210, a pair of lift feet 220 and a pair of springs 230. Support legs 210 may by U-shaped and may be received on a sill 12 of window 10 (FIG. 2). In particular, an interior projection 212 of each support leg 210 may extend downwardly along the vertical direction V from a base 214 of each support leg 210 that is positioned on the sill 12 of window 10. A wall post 213 on interior projection 212 of each support leg 210 may extend along the transverse direction T to an interior wall below window 10. Thus, wall posts 213 may brace support legs 210 on the interior wall below window 10. Interior casing 112 may rest on interior projections 212 when mounting bracket 200 is installed on window 10.

An exterior projection 216 of each support leg 210 may also extend downwardly along the vertical direction V from base 214 of each support leg 210 (e.g., parallel to interior projection 212). However, exterior projection 216 of each support leg 210 may be positioned opposite each interior projection 212 of support leg 210 on base 214 along the transverse direction T, and a wall post 217 on exterior projection 216 of each support leg 210 may extend along the transverse direction T to an exterior wall below window 10. Thus, wall posts 217 may brace support legs 210 on the exterior wall below window 10. Exterior casing 114 may rest on exterior projections 216 when mounting bracket 200 is installed on window 10.

In the above described manner, support legs 210 may be received on sill 12 of window 10 to support casing assembly 110. One or more cross-braces 218 may extend between support legs 210 along the lateral direction L, and cross-braces 218 may rest against sill 12 of window 10. Wall posts 213, 215 and cross-braces 218 may cooperate to lock mounting bracket 200 at window 10.

Each of the lift feet 220 is slidably mounted to a respective one of the support legs 210. Thus, each of the lift feet 220 may slide upwardly and downwardly along the vertical direction V on the respective one of the support legs 210. Each of the springs 230 is coupled to a respective one of the lift feet 220. Springs 230 may urge exterior casing 114 upwardly along the vertical direction V during installation of saddle window air conditioner 100, as discussed in greater detail below.

Figure 8:
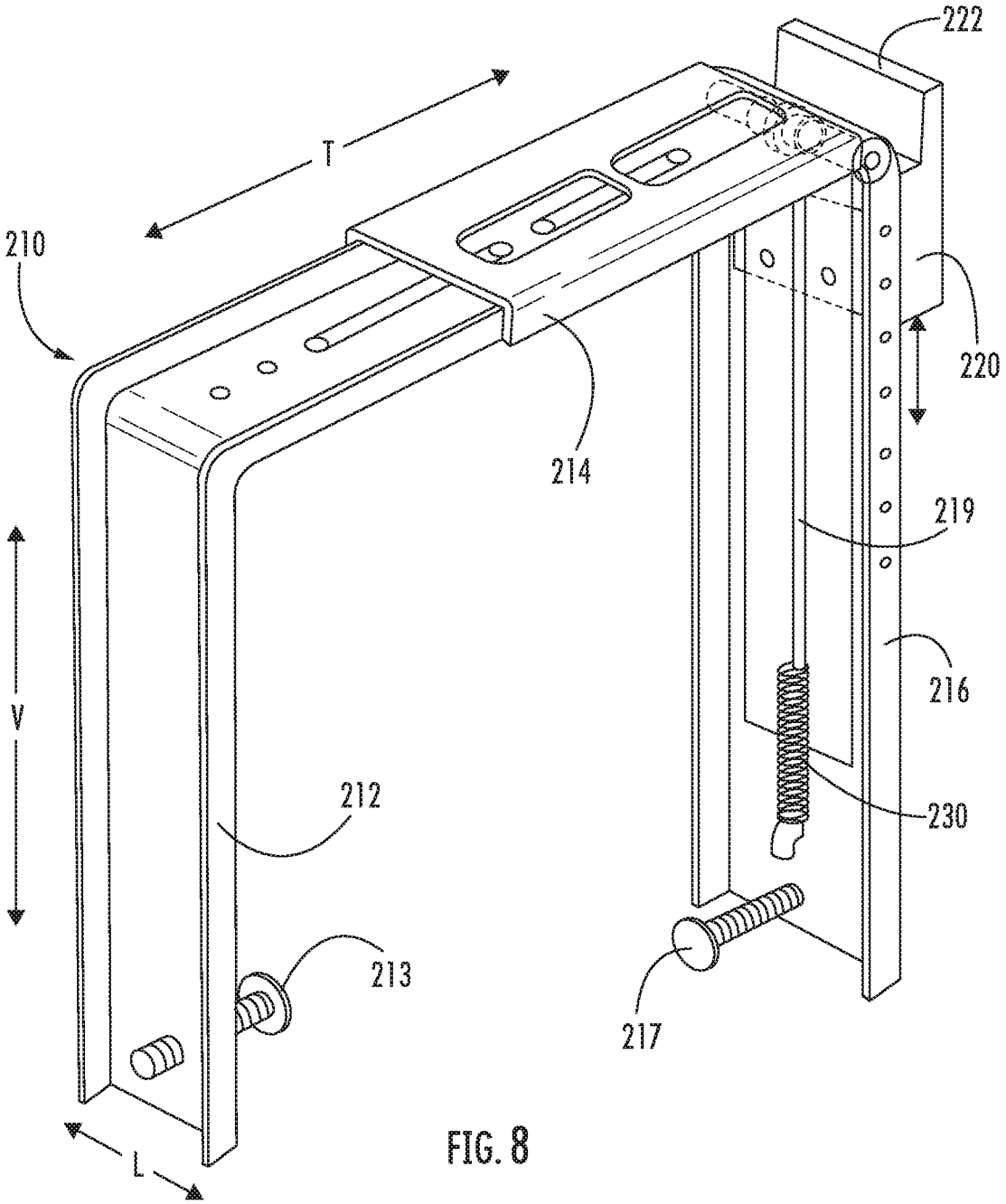
FIG. 8 is a perspective view of a support leg of the mounting bracket of FIG. 7.

FIG. 8 is a perspective view of one or support legs 210 of mounting bracket 200. As may be seen in FIG. 8, spring 230 may be mounted to support legs 210 at exterior projection 216. A cable 219 may extend between spring 230 and lift foot 220 to couple spring 230 to lift foot 220. Lift foot 220 is connectable to exterior casing 114. For example, a projection 222 of lift foot 220 is receivable within a slot 113 (FIG. 5) on a bottom of exterior casing 114. Interference between projection 222 and exterior casing 114 at slot 113 may couple lift foot 220 to exterior casing 114.

Spring 230 urges lift foot 220 and exterior casing 114 upwardly along the vertical direction V on support leg 210 when mounting bracket 200 is positioned in window 10 and lift foot 220 is connected to exterior casing 114. For example, during installation of saddle window air conditioner 100, an installer may insert exterior casing 114 through window 10 until exterior casing 114 is positioned at or contiguous with an exterior atmosphere and chaseway 130 is positioned over sill 12 of window 10. Casing assembly 110 may be positioned over mounting bracket 200 as the installer inserts exterior casing 114 through window 10. Lift feet 220 and springs 230 assist with lowering casing assembly 10 downwardly along the vertical direction V in a controlled manner. The installer may position projection 222 of lift foot 220 within slot 113 on the bottom of exterior casing 114 when lift foot 220 is at the top of support leg 210, and springs 230 may bear a portion of the weight of casing assembly 110 as the installer lowers casing assembly 110 downwardly along the vertical direction V. For example, spring 230 may urge lift foot 220 and exterior casing 114 upwardly along the vertical direction V to assist with avoiding uncontrolled downward movement of casing assembly 110.

Springs 230 may be suitable dimensioned/configured to assist with bearing casing assembly 110. For example, a spring constant of spring 230 may be no less than ten pounds (10 lbs.) per foot and no greater than seventy pounds (70 lbs.) per foot. It will be understood that such description of the spring constant of spring 230 may refer to the collective spring constant of springs 230. Such sizing of springs 230 may assist with bearing a suitable portion of the weight of casing assembly 110 during installation of saddle window air conditioner 100.

As described above, components of saddle window air conditioner 100 within interior casing 112 are separated from components of saddle window air conditioner 100 within exterior casing 114 by a telescoping chaseway 130. Chaseway 130 may contain refrigeration tubing, electrical wiring and/or condensate tubing that connect the components of saddle window air conditioner 100 within interior casing 112 with the components of saddle window air conditioner 100 within exterior casing 114. Chaseway 130 allows saddle window air conditioner 100 to expand/contract to fit into various window dimensions. Float switch 144 also determines when liquid runoff has accumulated within interior casing 112, and pump 142 flows the liquid runoff to exterior casing 114 where the liquid runoff may be drained or evaporated on exterior coil 126.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A saddle window air conditioner, comprising:

an interior casing;

an exterior casing spaced from the interior casing;

a chaseway extending between the interior casing and the exterior casing, the chaseway comprising a first sleeve mounted to one of the interior casing and the exterior casing, a second sleeve mounted to the other of the interior casing and the exterior casing, the first sleeve slidably received within the second sleeve such that a length of the chaseway between the interior casing and the exterior casing is adjustable by sliding the first sleeve within the second sleeve; and a mounting bracket mountable at a window, the mounting bracket comprising a support leg, a lift foot slidably mounted to the support leg, and a spring coupled to the lift foot, the lift foot connectable to the exterior casing, the spring urging the lift foot and the exterior casing upwardly on the support leg when the mounting bracket is positioned in the window and the lift foot is connected to the exterior casing.

2. The saddle window air conditioner of claim 1, wherein a projection of the lift foot is receivable within a slot on a bottom of the exterior casing.

3. The saddle window air conditioner of claim 1, wherein a spring constant of the spring is no less than ten pounds per foot and no greater than fifty pounds per foot.

4. The saddle window air conditioner of claim 1, wherein the chaseway further comprises a slide rail for slidably mounting the first sleeve to the second sleeve.

5. The saddle window air conditioner of claim 1, wherein the chaseway further comprises a lock for fixing the length of the chaseway.

6. The saddle window air conditioner of claim 1, wherein the mounting bracket further comprises a wall post extending from the support leg, a distal end of the wall post positionable on a wall below the window.

7. The saddle window air conditioner of claim 1, further comprising a sealed system with a fan, an evaporator, a compressor, and a condenser, the fan and the evaporator positioned within the interior casing, the compressor and the condenser positioned within the exterior casing.

8. The saddle window air conditioner of claim 7, wherein the sealed system further comprises a condensate tube within the chaseway, the condensate tube configured to flow liquid runoff from the evaporator to the exterior casing.

9. The saddle window air conditioner of claim 8, wherein the sealed system further comprises a pump and a float switch, the pump operable to flow the liquid runoff from the evaporator to the exterior casing through the condensate tube, the float switch coupled to the pump such that the pump activates in response to the float switch detecting a predetermined fill level of liquid runoff.

10. A saddle window air conditioner, comprising:

an interior casing;

an exterior casing spaced from the interior casing;

a chaseway extending between the interior casing and the exterior casing, the chaseway comprising a first sleeve mounted to one of the interior casing and the exterior casing, a second sleeve mounted to the other of the interior casing and the exterior casing, the first sleeve slidably received within the second sleeve such that a length of the chaseway between the interior casing and the exterior casing is adjustable by sliding the first sleeve within the second sleeve; and a mounting bracket mountable at a window, the mounting bracket comprising a pair of support legs, a pair of lift feet and a pair of springs, each of the pair of lift feet slidably mounted to a respective one of the pair of the support legs, each of the pair of springs coupled to a respective one of the pair of lift feet, the pair of lift feet connectable to the exterior casing, the pair of springs urging the pair of lift feet and the exterior casing upwardly on the pair of support legs when the mounting bracket is positioned in the window and the pair of lift feet is connected to the exterior casing.

11. The saddle window air conditioner of claim 10, wherein a projection of on each of the pair of lift feet is receivable within a respective slot on a bottom of the exterior casing.

12. The saddle window air conditioner of claim 10, wherein a collective spring constant of the pair of springs is no less than ten pounds per foot and no greater than seventy pounds per foot.

13. The saddle window air conditioner of claim 10, wherein the chaseway further comprises a slide rail for slidably mounting the first sleeve to the second sleeve.

14. The saddle window air conditioner of claim 10, wherein the chaseway further comprises a lock for fixing the length of the chaseway.

15. The saddle window air conditioner of claim 10, further comprising a sealed system with a fan, an evaporator, a compressor, and a condenser, the fan and the evaporator positioned within the interior casing, the compressor and the condenser positioned within the exterior casing.

16. The saddle window air conditioner of claim 15, wherein the seated system further comprises a condensate tube within the chaseway, the condensate tube configured to flow liquid runoff from the evaporator to the exterior casing.

17. The saddle window air conditioner of claim 16, wherein the sealed system further comprises a pump and a float switch, the pump operable to flow the liquid runoff from the evaporator to the exterior casing through the condensate tube, the float switch coupled to the pump such that the pump activates in response to the float switch detecting a predetermined fill level of liquid runoff.

* * * * *